US008171986B2

(12) United States Patent
Klein

(10) Patent No.: US 8,171,986 B2
(45) Date of Patent: May 8, 2012

(54) FOAM METAL HEAT EXCHANGER SYSTEM

(75) Inventor: John Frederick Klein, Port Washington, NY (US)

(73) Assignee: Northrop Grumman Systems Corporation, Los Angeles, CA (US)

( * ) Notice: Subject to any disclaimer, the term of this patent is extended or adjusted under 35 U.S.C. 154(b) by 1071 days.

(21) Appl. No.: 12/060,917

(22) Filed: Apr. 2, 2008

(65) Prior Publication Data

US 2009/0250191 A1 Oct. 8, 2009

(51) Int. Cl.
*F28F 3/06* (2006.01)

(52) U.S. Cl. ..... 165/166; 165/168

(58) Field of Classification Search ..... 165/166, 165/168

See application file for complete search history.

(56) References Cited

U.S. PATENT DOCUMENTS

| | | | | |
|---|---|---|---|---|
| 3,752,422 | A | 8/1973 | Runnels et al. | |
| 4,136,427 | A | 1/1979 | Shum | |
| 5,097,892 | A | 3/1992 | Beamer | |
| 5,145,001 | A | 9/1992 | Valenzuela | |
| 5,860,472 | A * | 1/1999 | Batchelder | 165/185 |
| 6,000,210 | A | 12/1999 | Negulescu | |
| 6,434,968 | B2 | 8/2002 | Buchholz et al. | |
| 2001/0032720 | A1 | 10/2001 | Eesley et al. | |
| 2001/0045270 | A1 | 11/2001 | Bhatti et al. | |
| 2003/0168210 | A1 | 9/2003 | Dunn | |
| 2004/0123980 | A1 | 7/2004 | Queheillalt et al. | |
| 2004/0226702 | A1 | 11/2004 | Toonen et al. | |
| 2006/0157225 | A1 * | 7/2006 | Martin et al. | 165/80.4 |

FOREIGN PATENT DOCUMENTS

| | | |
|---|---|---|
| WO | WO 99/18602 | 4/1999 |

OTHER PUBLICATIONS

J. F. Klein et al., "Thermal Management of Airborne Early Warning and Electronic Warfare Systems Using Foam Metal Fins", Technology Review Journal, Spring/Summer 2005, pp. 103-127.

* cited by examiner

*Primary Examiner* — Teresa Walberg
(74) *Attorney, Agent, or Firm* — Robert P. Lenart, Esq.; Pietragallo Gordon Alfano Bosick & Raspanti, LLP

(57) ABSTRACT

An apparatus includes a foam metal panel heat exchanger core positioned in a duct, an inlet flow passage for directing a first fluid to the heat exchanger core, and an exit flow passage for directing the first fluid from the heat exchanger core, wherein the inlet flow passage is tapered relative to an inlet face of the heat exchanger core and the exit flow passage is tapered relative to an outlet face of the heat exchanger core. The first fluid has a substantially uniform flow distribution through the core. The inlet and exit flow passages can be adjacent to each other. The core can be formed of a compressed foam.

17 Claims, 8 Drawing Sheets

FOAM METAL HEAT EXCHANGER SYSTEM

FIELD OF THE INVENTION

This invention relates to heat exchangers, and more particularly to heat exchangers that include a foam metal element.

BACKGROUND OF THE INVENTION

Military and civilian electronic, avionic and power applications need to package devices in less space, using less weight, and/or using lower electronic device operating temperatures. Heat must be removed from the devices and rejected to the surrounding environment. Conventional cooling systems for aircraft applications are becoming larger and heavier than desired.

Increasing heat loads on aircraft require increased heat rejection. There is a need for improved heat exchangers that can take advantage of the properties of foam metals.

SUMMARY OF THE INVENTION

In an first aspect, the invention provides an apparatus including a foam metal panel heat exchanger core positioned in a duct, an inlet flow passage for directing a first fluid to the heat exchanger core, and an exit flow passage for directing the first fluid from the heat exchanger core, wherein the inlet flow passage is tapered relative to an inlet face of the heat exchanger core and the exit flow passage is tapered relative to an outlet face of the heat exchanger core.

The first fluid has a substantially uniform flow distribution through the core. The inlet and exit flow passages can be adjacent to each other. The core can be formed of a compressed foam.

In another aspect, the invention provides an apparatus including a foam metal heat exchanger, a duct structured and arranged to provide uniform flow through the heat exchanger, and means for causing a fluid to flow through the foam metal heat exchanger.

In another aspect, the invention provides an apparatus including a plurality of foam metal cores positioned adjacent to each other and separated by plates, wherein the foam metal cores are structured and arranged such that a first fluid flows in a first direction through a first set of the cores and a second fluid flows in a second direction through a second set of the cores.

In another aspect, the invention provides an apparatus including a heat exchanger core with foam metal attached to a heated surface to be cooled.

DETAILED DESCRIPTION OF THE INVENTION

In one aspect, the invention provides compact lightweight heat exchangers for aircraft cooling. Core weight and/or volume can be as little as half that of advanced conventional fins.

When used on an aircraft, this invention provides a system which uses ram air to cool a lightweight foam metal heat exchanger located in either an external mounted pod or employs an air scoop to force air through a heat exchanger located inside the aircraft structure. In some cases ground test/verification of the electronics requires an integral cooling fan for ground operation.

Figure 1:
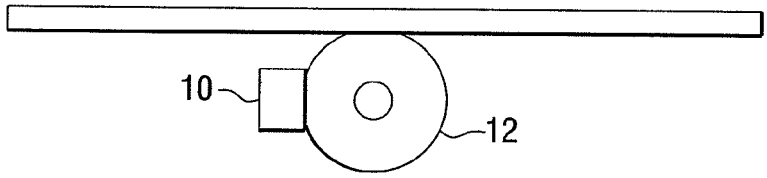
FIG. 1 is a schematic representation of a heat exchanger mounted on an aircraft fuselage in accordance with an embodiment of the invention.
Figure 2:
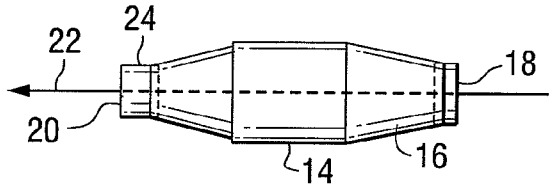
FIG. 2 is a schematic representation of a heat exchanger constructed in accordance with the invention.

FIG. 1 is a schematic representation of a heat exchanger 10 mounted on an aircraft fuselage 12. FIG. 2 illustrates a foam metal heat exchanger system mounted in an aircraft side pod. The heat exchanger includes a foam metal heat exchanger core 14 mounted in a duct 16. The duct includes an inlet 18 and an outlet 20. Air flows through the duct and core in the direction indicated by arrow 22. During operation of the aircraft, forward movement of the aircraft causes ram air to pass through the duct and core. A prime mover in the form of a fan or pump 24 can be included to force air through the duct and core when the aircraft is on the ground.

In the example of FIG. 2, the pod would be mounted outside the fuselage under the wing. Ram air flows into the inlet due to aircraft motion. The air flows through ductwork to guide it to the foam metal heat exchanger. After passing through the foam metal heat exchanger the air is guided by additional ductwork to an exhaust fan. The exhaust fan can be configured for operation on the ground only or it could be configured for in-flight operation. The ductwork between the heat exchanger and the fan could include blowout doors, which allow air to bypass the fan when it is not operating. The foam metal heat exchanger core is smaller and lighter than cores of conventional heat exchangers.

Various configurations of foam metal elements that can be used for various heat exchanger applications are described below.

Figure 3:
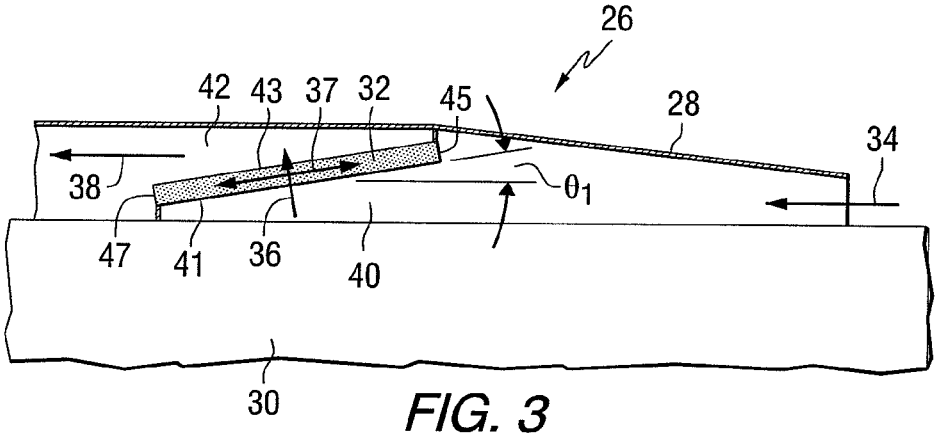
FIG. 3 is a schematic representation of another heat exchanger constructed in accordance with the invention.

FIG. 3 is a schematic representation of another heat exchanger assembly 26 constructed in accordance with the invention. The heat exchanger assembly includes a duct 28 mounted on an aircraft body 30. The duct can be formed of, for example, sheet metal. A foam metal heat exchanger core, or panel, 32 is positioned in the duct and mounted at an acute angle $\theta_1$ with respect to the direction of air flow through the duct. Forward movement of the aircraft causes ram air to flow through the duct and panel in the direction indicated by arrows 34, 36 and 38. An inlet flow passage 40 directs air to the heat exchanger core. The heat exchanger core is mounted such that the inlet flow passage 40 is tapered with respect to a substantially planar inlet face 41 of the heat exchanger core. An outlet flow passage 42 directs air from the heat exchanger core. The heat exchanger core is mounted such that the outlet flow passage 42 is tapered with respect to a substantially planar outlet face 43 of the heat exchanger core. The design of FIG. 3 provides tapered inlet and exit flows. The tapering inlet/exit and their sizing are the key aspects of our invention.

The foam metal heat exchanger panel can be constructed of compressed foam metal. The compressed foam metal has a lower resistance to air flow in a direction in the plane of the panel (i.e., the direction of arrow 37) than in a direction perpendicular to the plane of the panel (i.e., the direction of arrow 36). Thus the incoming air passes through the panel relatively uniformly.

Figure 6:
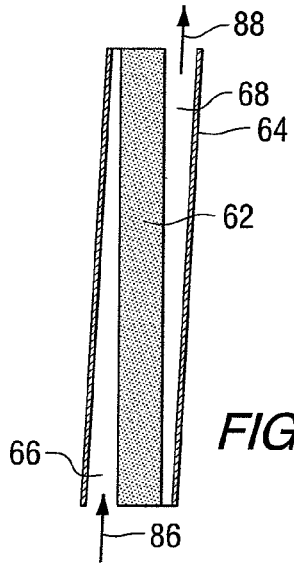
FIG. 6 is a cross-sectional view of the heat exchanger of FIG. 5 taken along line 6-6.
Figure 8:
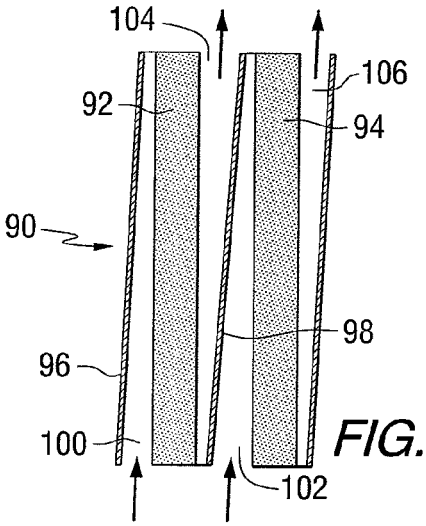
FIGS. 8 and 9 are top views of other heat exchangers constructed in accordance with the invention.
Figure 9:
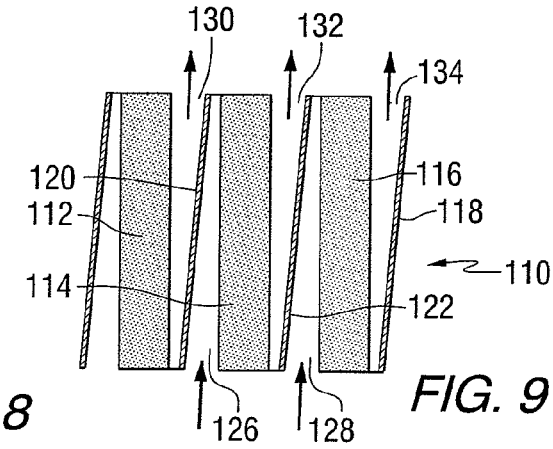

The inlet air duct height should generally be no more than 25% of the length of the core in the air flow direction. Otherwise the inlet-core-outlet assembly becomes too large and heavy for many applications. However, the larger the inlet duct height, the more uniform the air flow distribution will be over the face of the air side core. A good compromise for inlet duct height ($H_1$) is about 12% ±4% of the length (L) of the core. In addition to the inlet height, tapering the duct height from the inlet end 45 of the core to the other end 47 improves flow distribution uniformity. If multiple panels are used, this also helps save space between adjacent panel inlet/outlets. Saving this space enables the overall core assembly to be smaller and lighter. Duct height ($H_2$) at the end furthest from the inlet of about 5% +4% −1% of the core length (L) helps provide improved flow uniformity through the core panel. Shaping/sizing the outlet duct helps provide flow uniformity and improves packaging. The outlet duct can have its narrow height on the same end as the inlet duct maximum height, as shown in FIGS. 6, 8 and 9.

Figure 4:
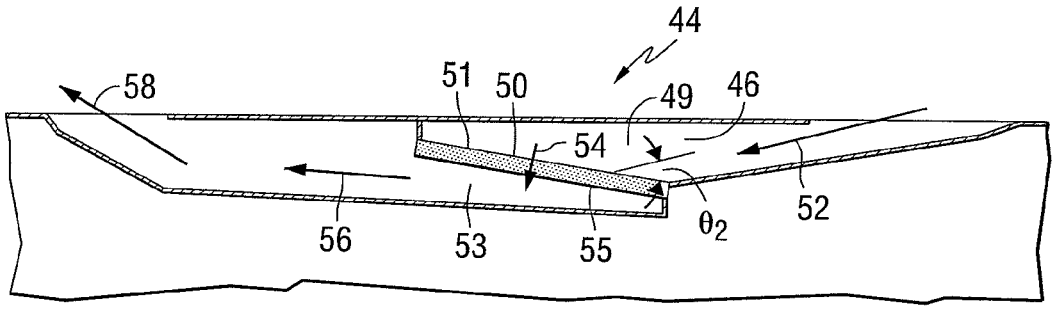
FIG. 4 is a schematic representation of another heat exchanger constructed in accordance with the invention.

FIG. 4 is a schematic representation of another heat exchanger assembly 44 constructed in accordance with the invention. The heat exchanger assembly includes a duct 46 mounted within an aircraft body 48. The duct can be formed of, for example, sheet metal. A foam metal heat exchanger core, or panel, 50 is positioned in the duct and mounted at an acute angle $\theta_2$ with respect to the direction of air flow through the duct. Forward movement of the aircraft causes ram air to flow through the duct and panel in the direction indicated by arrows 52, 54, 56 and 58. An inlet flow passage 49 directs air to the heat exchanger core. The heat exchanger core 50 is mounted within the duct such that the inlet flow passage 49 is tapered with respect to a substantially planar inlet face 51 of the heat exchanger core. An outlet flow passage 53 directs air from the heat exchanger core. The heat exchanger core is mounted such that the outlet flow passage 53 is tapered with respect to a substantially planar outlet face 55 of the heat exchanger core. The design of FIG. 4 provides tapered inlet and exit flows.

Figure 5:
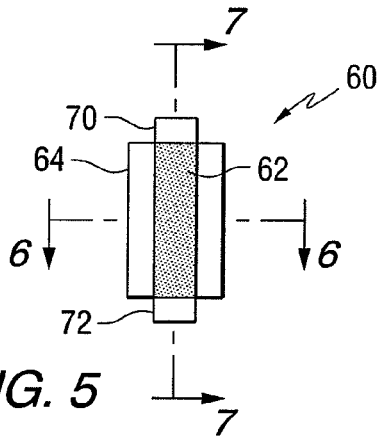
FIG. 5 is an end view of a heat exchanger constructed in accordance with the invention.
Figure 7:
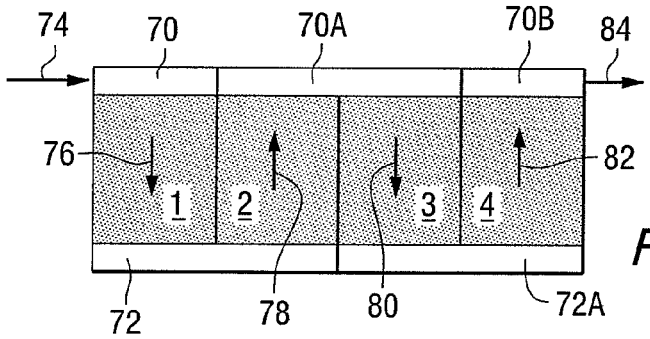
FIG. 7 is a cross-sectional view of the heat exchanger of FIG. 5 taken along line 7-7.

FIG. 5 is an end view of a heat exchanger 60. FIG. 6 is a cross-sectional view of the heat exchanger of FIG. 5 taken along line 6-6. FIG. 7 is a cross-sectional view of the heat exchanger of FIG. 5 taken along line 7-7.

The heat exchanger 60 includes a foam metal core 62 mounted in a duct 64. The duct and foam metal core are structured to define a tapered intake passage 66 and a tapered outlet passage 68 on opposite sides of the core. Liquid headers 70 and 72 are positioned on opposite edges of the core. In operation, air enters the intake passage, passes through the core, and exits through the outlet passage. A liquid coolant enters header 70 as shown by arrow 74, passes vertically through the core as indicated by arrows 76, 78, 80 and 82, and exits the header as shown by arrow 84. Air flows into the intake as shown by arrow 86, through the foam metal core, and out the outlet as shown by arrow 88. FIG. 7 is a single flat panel concept with a single pass on the air side and multiple passes (4) on the liquid side. Liquid enters header 70, flows down through section 1 of the core and turns in header 72, flows up through section 2 of the core and turns again in header 70A, flows down through section 3 of the core and turns again in header 72A.

FIGS. 8 and 9 are top views of core assemblies 90 and 110 for other heat exchangers constructed in accordance with the invention. The core assembly of FIG. 8 includes two flat panel cores 92 and 94 mounted in a duct 96. A separator 98 is positioned between the cores. This arrangement forms two inlets 100 and 102 and two outlets 104 and 106. The duct, foam metal cores, and separator are structured to define tapered intake passages and tapered outlet passages on opposite sides of the cores.

The core assembly of FIG. 9 includes three flat panel cores 112, 114 and 116 mounted in a duct 118. Two separators 120 and 122 are positioned between the cores. This arrangement forms three inlets 124, 126 and 128 and three outlets 130, 132 and 134. The duct, foam metal cores, and separator are structured to define tapered intake passages and tapered outlet passages on opposite sides of the cores.

Figure 10:
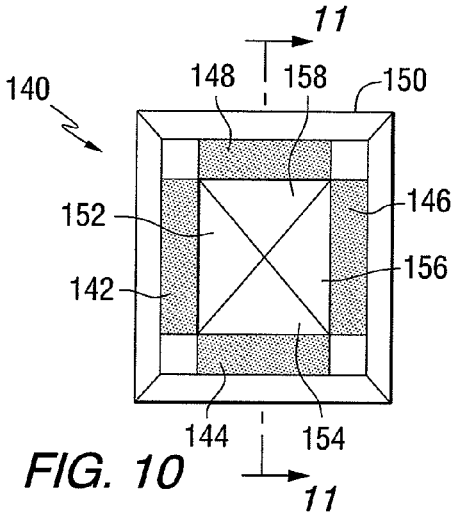
FIG. 10 is an end view of another heat exchanger constructed in accordance with the invention.
Figure 11:
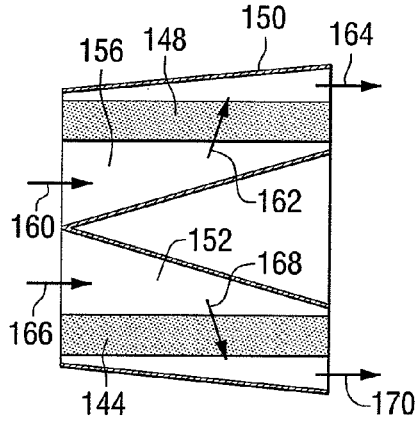
FIG. 11 is a cross-sectional view of the heat exchanger of FIG. 10 taken along line 11-11.
Figure 12:
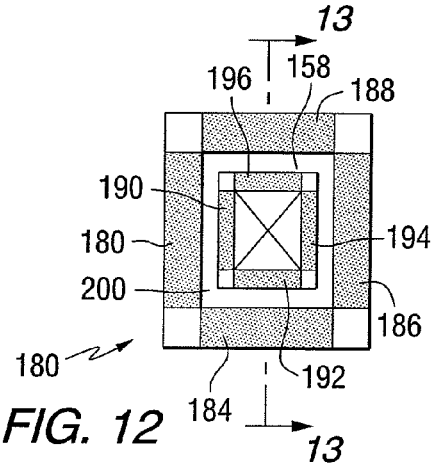
FIG. 12 is an end view of another heat exchanger constructed in accordance with the invention.
Figure 13:
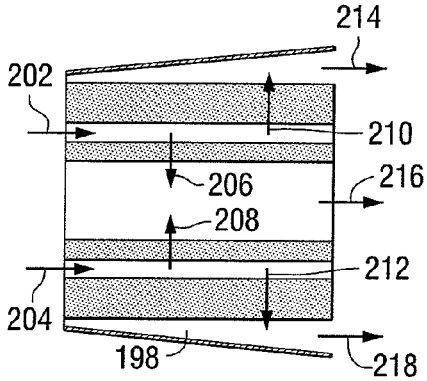
FIG. 13 is a cross-sectional view of the heat exchanger of FIG. 12 taken along line 13-13.

FIG. 10 is an end view of another heat exchanger 140 constructed in accordance with the invention. FIG. 11 is a cross-sectional view of the heat exchanger of FIG. 10 taken along line 11-11. The heat exchanger of FIGS. 10 and 11 includes four foam metal cores 142, 144, 146 and 148 arranged in a rectangular, or square, configuration in a duct 150. Separators or baffles 152, 154, 156 and 158 are positioned in the duct to direct air through the cores as illustrated by arrows 160, 162, 164, 166, 168 and 170. The duct, foam metal cores, and separators are structured to define tapered intake passages and tapered outlet passages on opposite sides of the cores. FIG. 12 is an end view of another heat exchanger 180 constructed in accordance with the invention. FIG. 13 is a cross-sectional view of the heat exchanger of FIG. 12 taken along line 13-13. The heat exchanger of FIGS. 12 and 13 includes eight foam metal cores 182, 184, 186, 188, 190, 192, 194 and 196 arranged in two concentric rectangular, or square, configurations in a duct 198. An inlet 200 is formed between the concentric core configurations. Air is directed through the cores as illustrated by arrows 202, 204, 206, 208, 210, 212, 214, 216 and 218. The duct, foam metal cores, and separator are structured to define tapered outlet passages adjacent to the outlet or exit sides of the cores.

Figure 14:
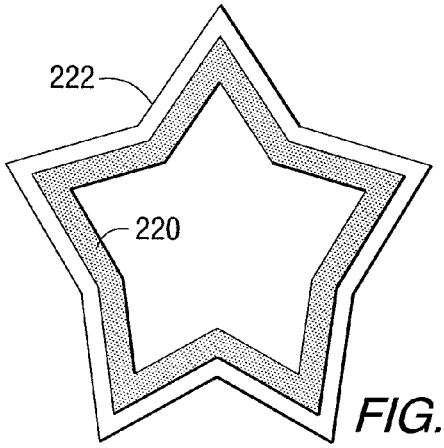
FIGS. 14 and 15 are cross-sectional views of other heat exchangers constructed in accordance with the invention.
Figure 15:
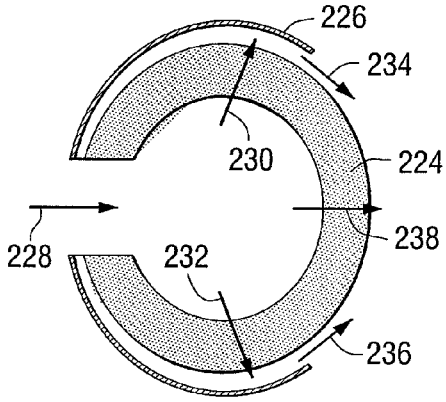
Figure 16:
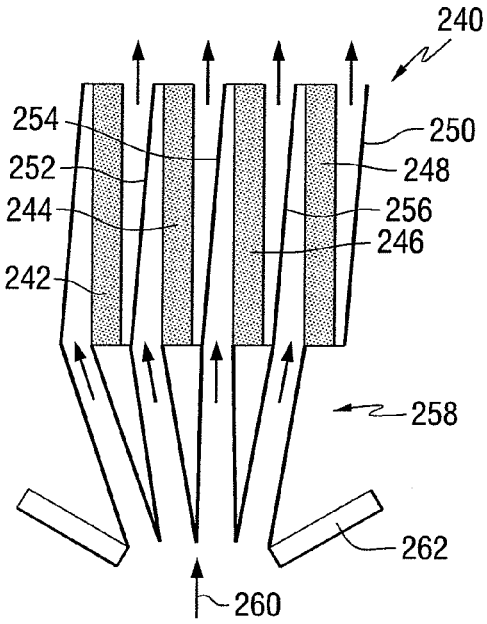
FIGS. 16, 17, 18, and 19 are schematic representations of other heat exchangers constructed in accordance with the invention.

A wide variety of core and duct configurations are possible. FIGS. 14 and 15 are cross-sectional views of other embodiments of the invention. FIG. 14 shows a complex polyhedron foam metal core 220 in a duct 222. FIG. 15 shows a cross-sectional view of a spherical or oblate sphere foam metal core 224 in a duct 226. Air flow is illustrated by arrows 228, 230, 232, 234, 236 and 238.

FIGS. 16, 17, 18, and 19 are schematic representations of other heat exchangers constructed in accordance with the invention. The heat exchanger 240 of FIG. 16 includes four cores 242, 244, 246 and 248 in a duct 250, with separators or baffles 252, 254 and 256 between the cores. An inlet diffuser 258 receives air as shown by arrow 260 and directs the air into the heat exchanger. An air scope 262 can be added to direct air into the diffuser.

Figure 17:
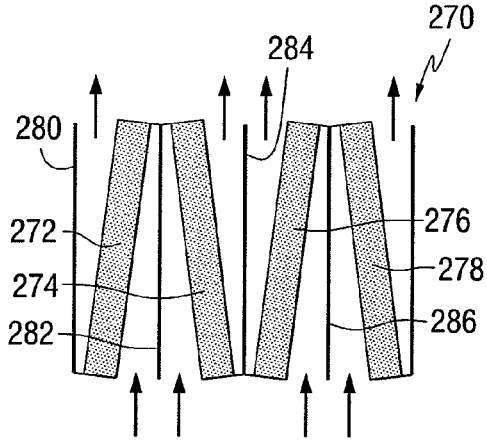

The heat exchanger 270 of FIG. 17 includes four cores 272, 274, 276 and 278 in a duct 280, with separators or baffles 282, 284 and 286 between the cores. In this example, the cores are arranged in a W configuration. The air flow direction is indicated by arrows in FIG. 17.

Figure 18:
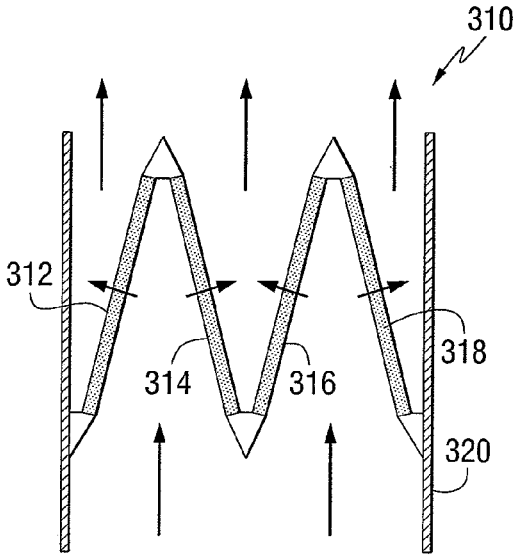

The heat exchanger 310 of FIG. 18 includes four cores 312, 314, 316 and 318 in a duct 320. In this example, the cores are arranged in a W configuration. The air flow direction is indicated by arrows.

Figure 19:
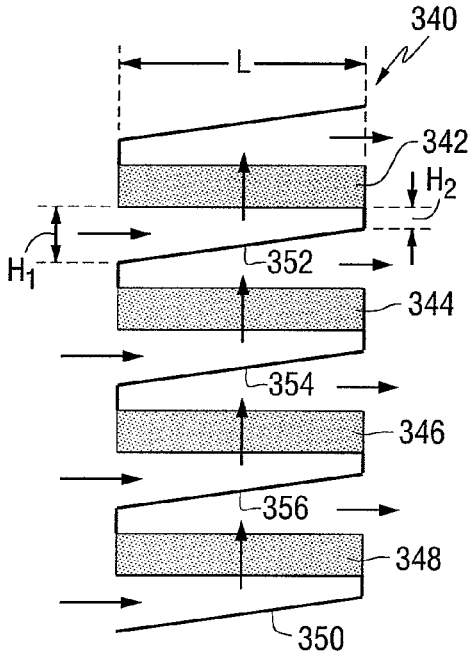

The heat exchanger 340 of FIG. 19 includes four cores 342, 344, 346 and 348 in a duct 350, with separators or baffles 352, 354 and 356 between the cores. The air flow direction is indicated by arrows. In the example of FIG. 19, the cores are positioned in planes that are parallel to the direction of the inlet air and the walls of the duct and baffles are angled to direct air into the cores.

Figure 20:
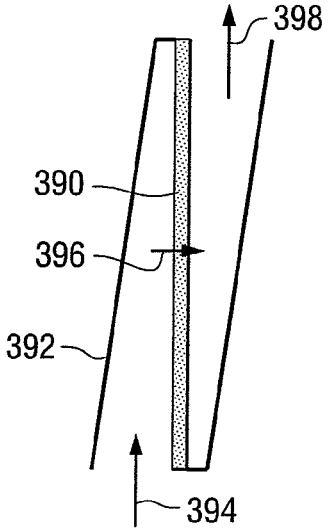
FIGS. 20 and 21 show additional angled foam metal concepts.
Figure 21:
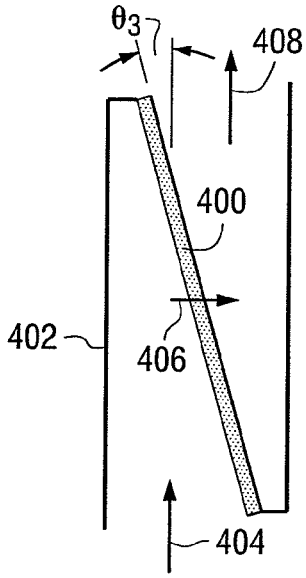
Figure 22:
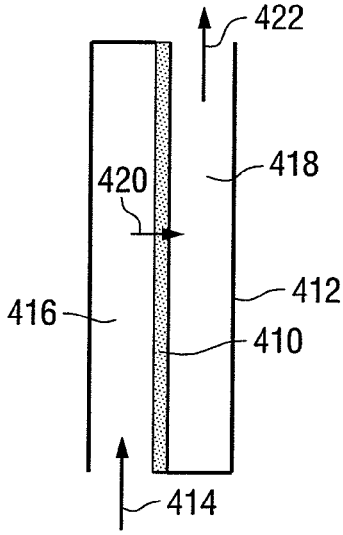
FIG. 22 shows a continuous height inlet (or outlet).

FIGS. 20, 21 and 22 show additional angled foam metal concepts. In FIG. 20, the foam metal core 390 is mounted in a duct 392 and positioned in a plane that is parallel to the direction of inlet air as illustrated by arrow 394. The sides of the duct are angled to direct air through the core and out the outlet as shown by arrows 396 and 398.

In FIG. 21, the foam metal core 400 is mounted in a duct 402 and positioned in a plane that is tilted at an angle $\theta_3$ with respect to the direction of inlet air as illustrated by arrow 404. The sides of the duct are substantially parallel to the direction of inlet air. Air flow through the core and out the outlet is indicated by arrows 406 and 408.

In FIG. 22, the foam metal core 410 is mounted in a duct 412 and positioned in a plane that is substantially parallel to the direction of inlet air as illustrated by arrow 414. The sides of the duct are also substantially parallel to the direction of inlet air, and form rectangular channels 416 and 418 on opposite sides of the core. Air flow through the core and out the outlet is indicated by arrows 420 and 422.

FIGS. 20, 21 and 22 illustrate three inlet duct/core geometry types: a tapered inlet duct with inlet flow parallel to the core face; a tapered duct with the inlet wall parallel to the air flow and a core positioned at an angle to flow; and a straight inlet duct with flow parallel to the core face.

Figure 23:
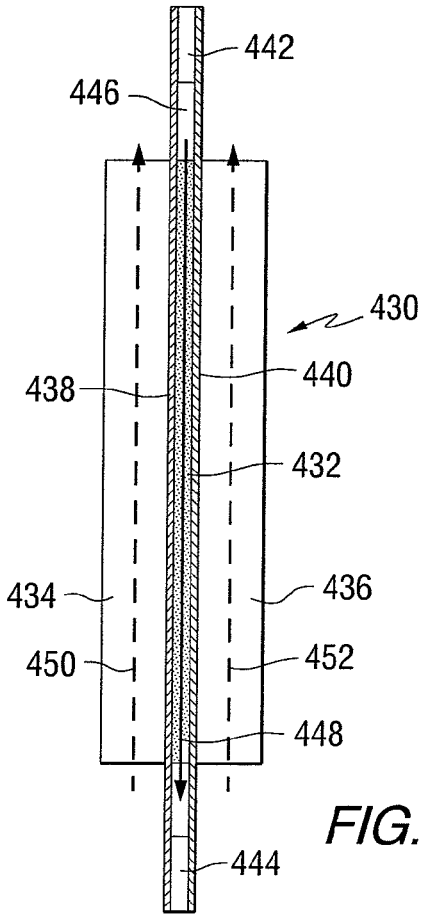
FIG. 23 is a detailed cross section of a heat exchanger core element.

FIG. 23 is an end view of another heat exchanger 430 constructed in accordance with the invention. The heat exchanger includes a first foam metal core 432 positioned between second and third foam metal cores 434 and 436. Plates 438 and 440 separate the cores. Liquid passage end caps 442 and 444 are positioned at opposite edges of the first foam metal core. The end caps and plates form a liquid passage plenums 444 and 446. Liquid in the plenum flows through the first foam metal core 432 as shown by arrow 448. Arrows 450 and 452 show the direction or air flow in the second and third foam metal cores 434 and 436.

Figure 24:
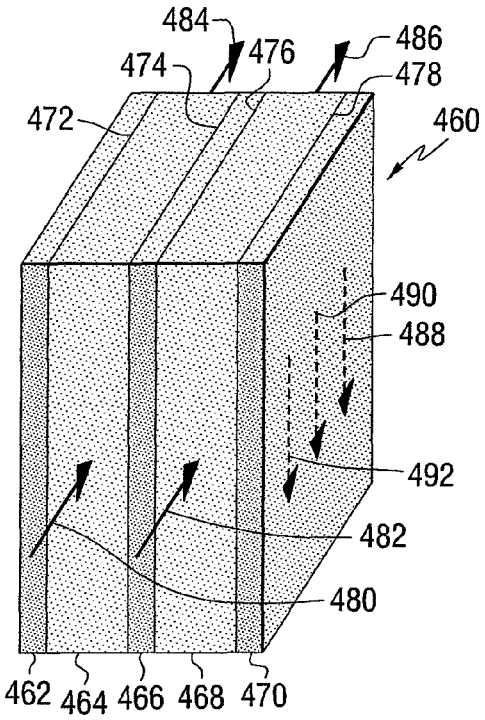
FIGS. 24 and 25 are isometric views of other heat exchangers constructed in accordance with the invention.
Figure 25:
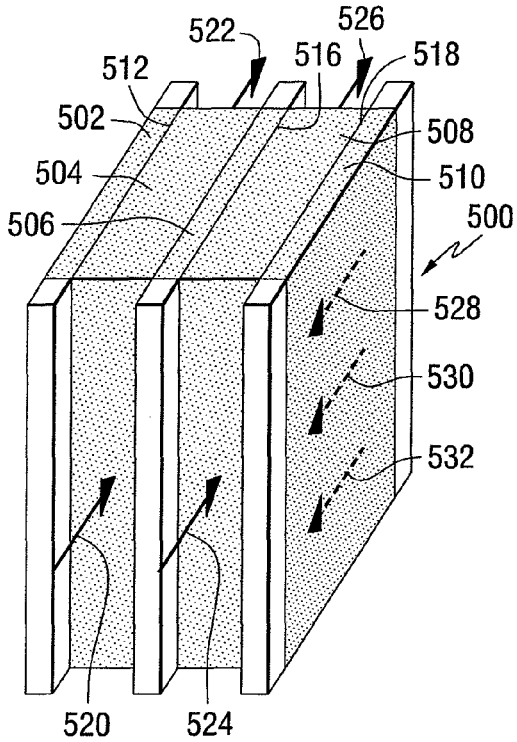
Figure 26:
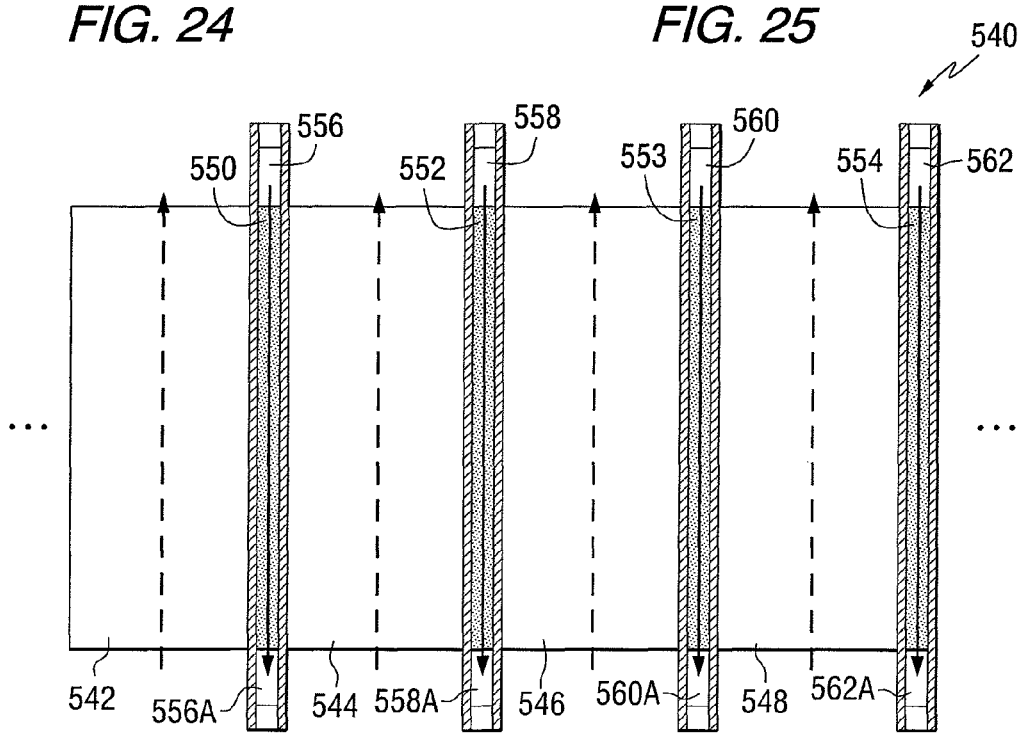
FIG. 26 is a detailed top view cross section of another heat exchanger constructed in accordance with the invention.

FIG. 23 is a cross section of an air/liquid foam metal heat exchanger core with foam metal on both air and liquid sides. FIG. 23 represents a single section of a core assembly. Core assemblies generally include many sections such as FIG. 23 stacked up with each other (i.e., as shown in FIG. 26). In this case the assembly can be brazed as one solid heat exchanger panel. A heat exchanger assembly may include several panels as illustrated by FIGS. 7 through 19. Foam metal heat exchangers can be either cross-flow or counter-flow types as illustrated in FIGS. 24 and 25. Counter-flow is the preferred method because it achieves high heat transfer per unit volume and allows more flexible panel packaging. Packaging a counter-flow heat exchanger is simply a matter of getting the required total face area with the right flow resistance into the space available. Design of heat exchanger packaging requires modification of the panel size with each packaging arrangement considered. In FIG. 23, air foams 434 and 436 and liquid foam are separated by thin sheet metal stock 438 and 440.

The foam metal has a higher flow resistance in the plane of the core, i.e., in a direction perpendicular to the fluid flow direction. This is what ensures that the flow goes perpendicular to the long face of the foam.

FIGS. 24 and 25 are isometric views of other heat exchangers constructed in accordance with the invention. The heat exchanger 460 of FIG. 24 includes five foam metal cores 462, 464, 466, 468 and 470. The cores are separated by plates 472, 474, 476 and 478. Air flows through cores 464 and 468, as shown by arrows 480, 482, 484 and 486. Liquid flows through cores 462, 466 and 460, a direction perpendicular to the direction of air flow, as illustrated by arrows 488, 490 and 492.

FIG. 24 shows a cross-flow configuration, wherein air (480, 482, 484, and 486) flows perpendicular to the liquid (488, 490, and 492). In the cross-flow configuration, liquid can flow through cores made of either foam metal or extruded fin stock (see FIGS. 31 and 32). Similarly, in FIG. 25 the liquid side can be either foam metal or extruded fin stock.

While this description refers to air and liquid, it should be understood that it also applies to two fluids, such as fluid 1 and fluid 2, with one fluid being a hot fluid, and the other fluid being a cold fluid. The heat exchanger can be separate air and liquid flow passages. Both air (cold) and liquid (hot) sides of the heat exchanger can have foam in them. The air and liquid side foams can also have different densities. A heat exchanger for submarine service may employ liquids flowing in both hot and cold side foams.

The heat exchanger 500 of FIG. 25 includes five foam metal cores 502, 504, 506, 508 and 510. The cores are separated by plates 512, 514, 516 and 518. Air flows through cores 504 and 508, as shown by arrows 520, 522, 524 and 526. Liquid flows through cores 502, 506 and 510, a direction anti-parallel to the direction of air flow, as illustrated by arrows 528, 530 and 532.

In the embodiment of FIG. 25, the invention provides a counter-flow, foam metal heat exchanger core for an aircraft liquid cooling system (LCS) heat exchanger. This core uses foam metal as the extended surface on both air and liquid sides of the heat exchanger. The resulting core is significantly smaller and lighter than both conventional and advanced conventional fin heat exchangers. Foam metal core volume and weight can be as little as half that of advanced conventional fins for the same overall performance parameters. Thermal testing of both single- and six-element cores has verified design/sizing improvements.

Figure 27:
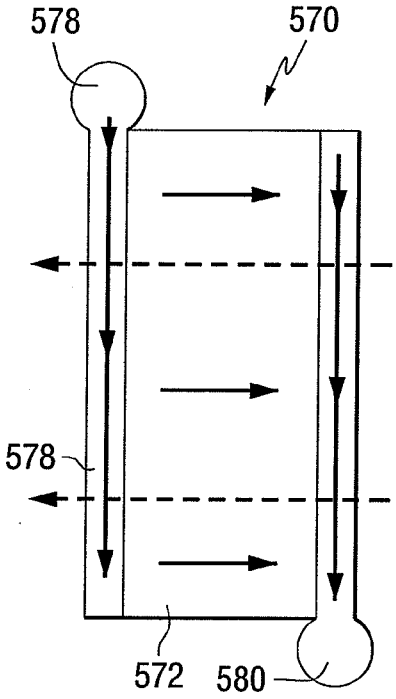
FIG. 27 is a side view of a heat exchanger assembly with a liquid inlet header and a liquid outlet header.

FIG. 26 is a side view of another heat exchanger panel 540 constructed in accordance with another aspect of the invention. This heat exchanger panel includes a first plurality of foam metal passages 542, 544, 546 and 548 that are configured to pass air, as illustrated by the dotted arrows, and a second plurality of foam metal passages 550, 552, 554 and 556 that are configured to pass liquid coolant, as illustrated by the solid arrows. Headers 556, 558, 560 and 562 are provided to direct the liquid coolant into the second plurality of foam metal panels. Headers 556A, 558A, 560A and 562A direct liquid coolant away from the liquid passages. A plurality of foam metal panels can be arranged in a stack to provide heat transfer between the air and liquid flow passages. Fluid is introduced into headers 556, 558, 560 and 562 by a main inlet header, shown as item 578 in FIG. 28, and removed from headers 556A, 558A, 560A and 562A by a main exit header, shown as item 580 in FIG. 28. FIG. 27 is an end view of a heat exchanger assembly 570 constructed in accordance with another aspect of the invention. The heat exchanger assembly 570 includes main inlet and exit liquid headers.

Figure 28:
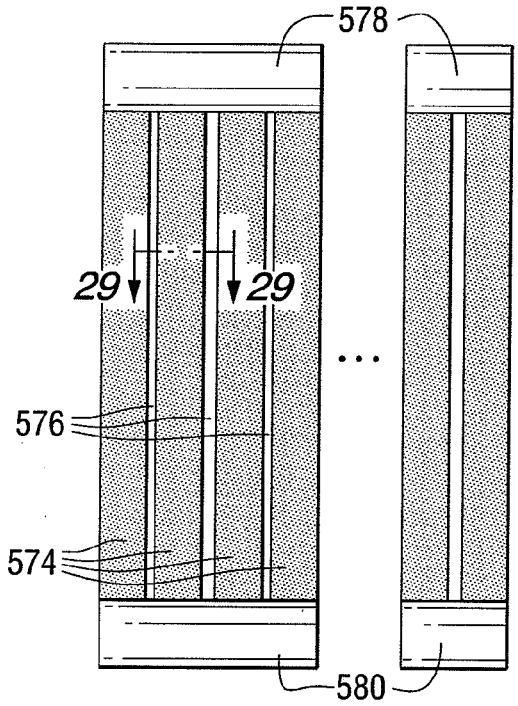
FIG. 28 is a cross section of the heat exchanger shown in FIG. 27.
Figure 29:
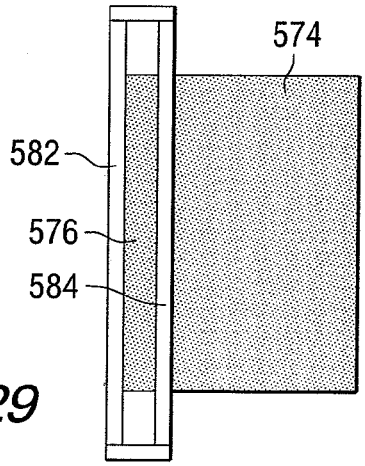
FIG. 29 is a cross-sectional view of one air/liquid pair of the heat exchanger of FIG. 28 taken along line 29-29.

FIG. 28 is a side view of the heat exchanger of FIG. 27. FIG. 29 is a cross-sectional view of one air/liquid pair of FIG. 28 taken along line 29-29. The heat exchanger includes a stack 572 of foam metal panels. The stack includes a first plurality of panels 574 for conducting air, and a second plurality of panels 576 for conducting liquid coolant. Headers 578 and 580 are provided to direct liquid coolant into panels 576. Separators 582 and 584 are positioned on opposite sides of each liquid coolant panel to contain the liquid coolant.

Figure 30:
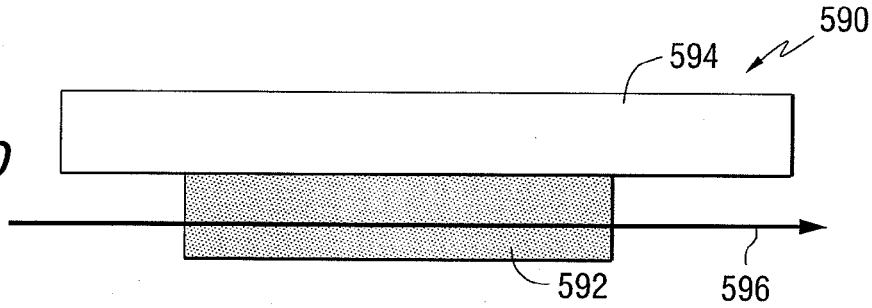
FIG. 30 is an example of using foam metal attached to a single surface to heat or cool the surface using fluid flowing in the foam metal.

FIG. 30 is a side view of another heat exchanger 590 constructed in accordance with another aspect of the invention. In this embodiment, a foam metal panel 592 is placed in thermal contact with a heated surface 594. Fluid is passed through the foam metal panel 592 to cool the heated surface, as illustrated by arrow 596.

While the invention can be used for aircraft applications as discussed above, it can also be used in marine and land applications, in which case, the heat exchanger can be mounted on a ship and forward movement of the ship would force water through the heat exchanger. A pump can be used in place of the fan to force water through the heat exchanger when the ship is docked.

The foam metal cores used in this invention are constructed of reticulated open cell foam metal. Reticulated foam porous metal provides a novel and efficient extended surface for heat transfer. Reticulated foam can be fabricated using many materials, such as, for example, T6061 aluminum. In one embodiment, the initial reticulated foam billets are fabricated to between 6-10% density of the parent material. The foam in the initial billet has a homogenous distribution of solid aluminum ligaments, with a roughly triangular cross section. The ligament structure is characterized as a dodecahedron. To achieve the desired heat transfer performance levels, the reticulated foam is tailored by compression.

The foam billet can be subject to uniaxial compression in a plane normal to the direction of an applied compressive force. After compression, there are more ligaments per unit area (volume). Several effects of foam compression have significance in this context. The first is that more ligaments per unit volume provide more heat transfer per unit volume. Furthermore, local heat transfer to the ligaments is increased somewhat by the higher internal velocity of fluid passing through the cells. Together these effects increase the heat transfer per unit volume.

Closer proximity of the ligaments, and the higher internal velocity of air passing through the foam metal, also result in higher air flow pressure drop in the direction of compression. Pressure drop in the direction transverse to the direction of compression increases more than in the direction of compression. Higher pressure drop per unit length in the direction transverse to the direction of compression is important for an angled flow heat exchanger core inlet design. This effect forces air to flow normal to the surface of the porous metal and to distribute across the foam face area. High pressure drop per unit length is mitigated by limiting air flow path length and taking advantage of corresponding increased heat transfer per unit length.

Reticulated foam ligament diameter is not uniform. Rather, it is a representative average value, determined by inspection under a microscope. It is smallest near the center of a ligament and largest near the ligament intersection nodes. The cross section of each ligament is triangular, with the sides of the triangle slightly concave toward the centerline. Ligament cross section shape is thought to increase local fluid turbulence and increase heat transfer with fluids flowing through the foam.

The ability to compress foams fabricated by direct-foaming reticulation is a major advantage for heat transfer optimization. The foam material ligament structure provides an extremely high heat exchanger surface area per unit volume. There is also a high local heat transfer between the solid ligaments and air flow. Aluminum foam can be given a thin anti-corrosion coating to provide corrosion resistance in a marine environment. These corrosion coating processes have a long history and are well developed, established production methods.

In addition to weight saving, porous metal heat exchangers have the capability to provide increased cooling capacity in a pod envelope. One factor in determining how much additional capacity can be added to the pod is an understanding of angled flow inlet/outlet design. In order to mitigate porous metal high pressure drop per unit length and take advantage of corresponding high heat transfer per unit length, porous metal heat exchangers tend to be relatively thin panels.

The foams can be fabricated by a direct-foaming/reticulation process. The cross-sectional area of ligaments for those foams is solid—an advantage for heat conduction. In foams fabricated by other methods such as precursor sintering processes, the ligament cross section is hollow in the center, which limits heat transfer along the ligaments and is thus a disadvantage for heat transfer. Such foams are manufactured by coating precursor polymer foam ligaments with a thin-layer slurry of the target foam material. Next, the coated precursor polymer foam is fired for sintering. The precursor burns off and a foam with somewhat porous ligaments remains. Ligament porosity is caused by polymer infiltration of the coating material during burn-off. Such foams tend to be brittle. It is difficult if not virtually impossible to optimize the structure of such foams, for use as an extended heat transfer surface by methods such as compression.

High values of specific surface area are advantageous for heat transfer. Compressing the foam and increasing the number of ligaments per unit volume results in high specific surface area. Compression also increases flow resistance. Hydraulic diameter is determined based on the compressed foam cell size, ligament diameter, and compressed foam cell density.

Foam metals can provide high extended surface heat transfer. However, pressure drop per unit length is relatively high. To manage the pressure drop per unit length, there is a trade-off for foam metal heat exchangers between approach face area velocity and flow length through the foam. For a given coolant mass flow, the approach face area determines the coolant normal face velocity. Coolant normal face velocity determines the coolant flow resistance per unit flow path length in the foam metal. The total flow length determines the total pressure drop. Because of these considerations, foam metal heat exchanger cores tend to have a high frontal area and short flow length. For various extended surfaces, the trade-off considerations are quite different. Therefore, the optimal design for one type of extended surface will be very different from the optimal design for another extended surface.

The best way to compare extended surface technologies is to optimize the heat exchanger based on each extended surface. Heat exchanger technologies can be compared on an equal basis by using top-level performance parameters, such as total heat exchanged; inlet and outlet temperatures; and total pressure drop on each side. On that basis, foam metal heat exchanger cores can have about half the volume and half the weight of optimized heat exchanger advanced fins, such as lanced offset fins. Other practical considerations include the size of the passages relative to clogging by debris.

Both cross-flow and counter-flow configurations can be used for foam metal heat exchangers. Alternating sections of air flow and liquid flow foam metal can be used to make up the heat exchanger core. In one application, both cross-flow and counter-flow heat exchanger cores have air flowing through the air side foam metal in a direction where the foam metal has a thickness of about one inch.

Figure 32:
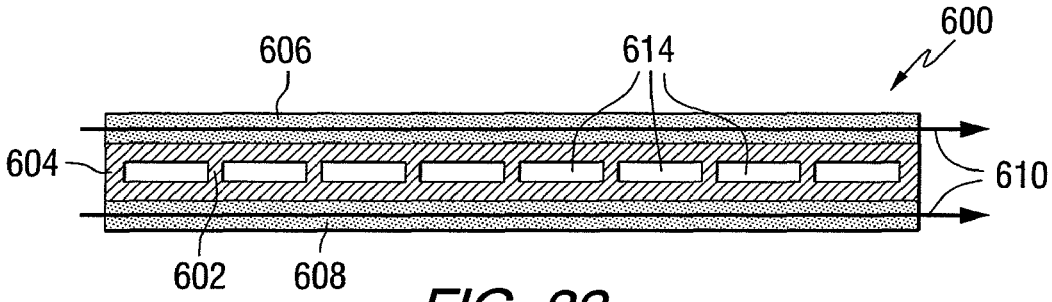
FIG. 32 is a cross-sectional view of the heat exchanger of FIG. 31 taken along line 32-32.
Figure 31:
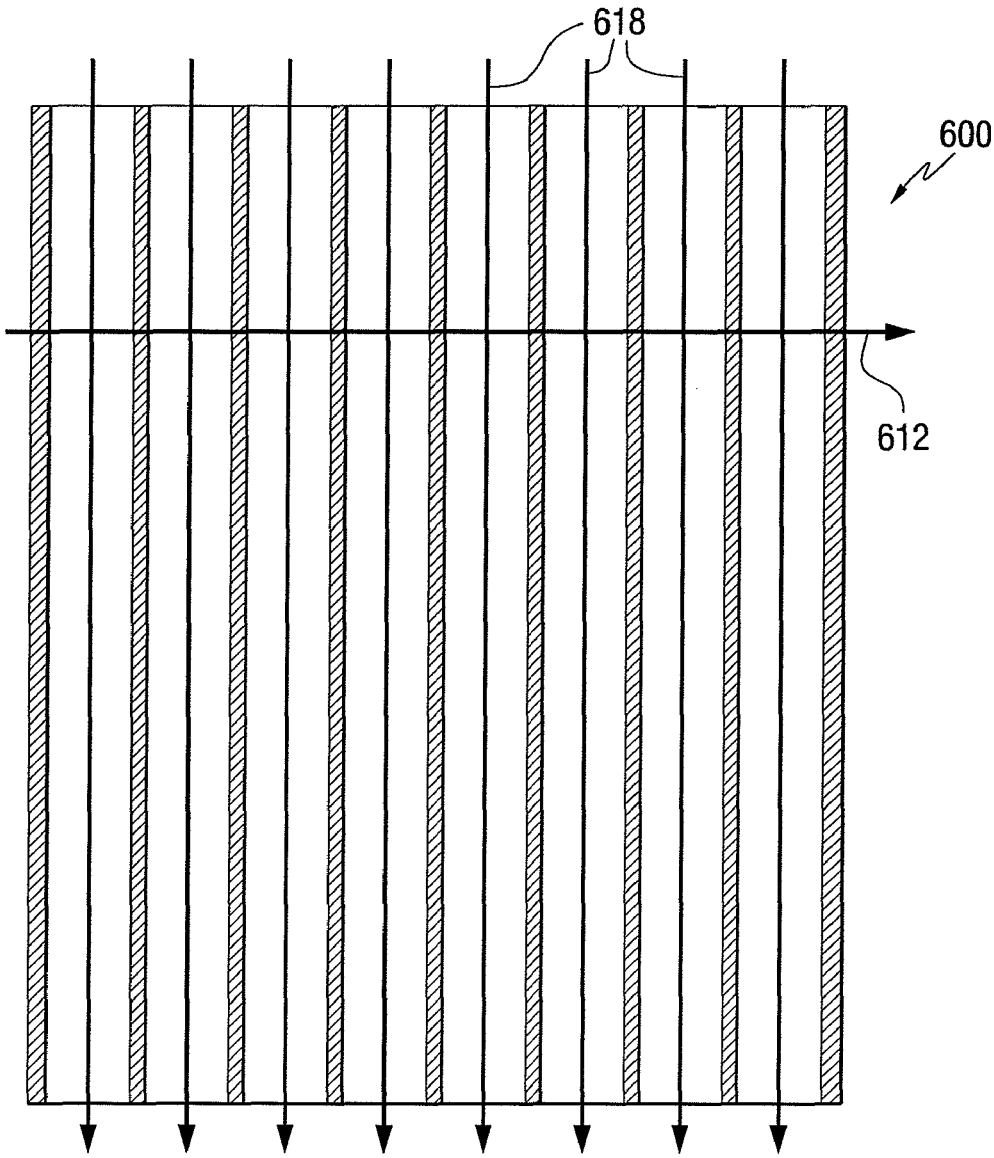
FIG. 31 is a cross-sectional view of a heat exchanger with integral fins.

Cross-flow liquid passages can be constructed using extruded aluminum passages with integral fins. Integral fins are fins, which also form the sides of a fluid, flow passage. FIG. 31 is a cross-sectional view of a heat exchanger 600 with integral fins 602. FIG. 32 is a cross-sectional view of the heat exchanger of FIG. 31 taken along line 32-32. A separator 604 is positioned between two metal foam panels 606 and 608. Air flows in the direction of arrows 610 and 612. Liquid flows through a plurality of openings 614 in the direction indicated by arrows 618.

Liquid flows through the length of extrusion, in a direction across the air flow. In contrast, in a counter-flow core, liquid flows through the liquid passage in a direction, counter (or anti-parallel) to air flow. The counter-flow core uses compressed foam metal as its extended surface on the liquid side. Counter-flow core could use either a planar flow passage or another extended surface. This would result in somewhat lower performance, measured as heat transfer per unit volume.

In one example, a counter-flow heat exchanger core resulted in a few pounds savings in core weight. Another advantage of a counter-flow core is that it allows more packaging flexibility than a cross-flow core. Changing the cross-flow liquid side length affects the total heat exchanged. Therefore, changing the shape for the cross-flow core panel frontal area changes the total heat exchanged. In contrast, as long as the total air mass flow, approach velocity, and total frontal area are maintained for a foam metal counter-flow core, the panel frontal area shape can be adjusted to meet specific packaging requirements. Air flow design must be carefully done to ensure uniform air flow distribution across the entire heat exchanger face.

While uniform flow across the face is desirable, in practical terms the flow is rarely exactly uniform. A key advantage of this invention is that the flow is closer to uniform with lower pressure drop than for a uniform height inlet. There is a relationship between the pressure drop through the foam and the dynamic head of the air flow. Ideally the pressure drop through the foam (e.g., FIG. 20 item 396, FIG. 21 item 406, or FIG. 22 item 420) is 10-15 times the dynamic head of the air flow entering the inlet channels (e.g., FIG. 20 item 394, FIG. 21 item 404, or FIG. 22 item 414). A similar dynamic head for the air or less is sought on the outlets 398, 409 and 422 of FIGS. 20, 21 and 22 respectively. Tapered inlets and exits can tolerate pressure drop ratios as low as 6-7 and achieve flow uniformity of ±10% of foam face velocity. Dynamic head is (air density)*(air velocity)$^2$, or in engineering symbols ($\rho V^2$). The pressure ratio is $(AP_{foam})/(\rho V^2)_{air\ inlet}$.

Heat exchangers can be constructed as a stack of legs for conducting fluids. The liquid legs can be extruded fin stock channels. For ease of fabrication, each leg can be fabricated individually. In one example, individual legs can then be mechanically stacked up to form a heat exchanger subpanel. Silicon rubber gaskets can be used to seal the assembly to side mounting flanges. Cork gaskets, which seal the interface between individual elements, can be positioned between adjacent half-height air foam passages. The cork gaskets can be on a plane of heat transfer symmetry. In another example, multiple air/liquid legs can be brazed to form a panel. FIG. 23 is a single leg 2-air/1-liquid design. FIGS. 23, 24 and 25 show sections of a multiple leg panel. A complete panel would have many legs. The heat exchanger panels in one application have about 30 legs per panel.

In various embodiments, the invention provides a lightweight compact foam metal heat exchanger, located in either an external pod, surface mounted flow ductwork, or ductwork located inside the aircraft. Ground based and/or flight air flow can be driven by a fan mounted in the ductwork. Foam metal heat exchangers tend to have high pressure drop per unit flow distance of the coolant. However, they also have corresponding high heat transfer per unit surface area. Removal of the same amount of heat as a conventional finned heat exchanger can be accomplished for the same cooling fluid pressure drop with short fluid flow path and low face velocity. As a result, foam metal heat exchanger cores tend to be large frontal area panels. This is contrasted with conventional heat exchangers, which tend to have smaller frontal areas, longer flow paths, and higher core volumes and weights. For ship mounted embodiments, water would pass through the duct and the heat exchanger core.

Foam metal heat exchanger panels can be arranged in numerous geometries to suit application needs. This allows great flexibility in packing foam metal heat exchangers. Foam metal heat exchangers have size, shape, volume, weight and frontal area advantages over conventional fin heat exchangers for this realistic example application. Since foam metal heat exchanger panels have some degree of structural strength, the heat exchanger panel could be part of low load bearing structure.

FIG. 19 illustrates a preferred packaging for use in an external side pod as illustrated in FIG. 1, wherein the foam metal panels are oriented such that the large flat face is in the plane of aircraft flight. Inlet and outlet passages are as shown by the horizontal arrows in FIG. 19. During flight, air flow is forced through the heat exchanger core by ram air. For some designs the panels are at an acute angle relative to the intake flow, as in FIG. 18. For other designs the panels are parallel to the intake flow. The essential physics common to both designs is that the flow passage tapers relative to the large flat face of the panels. This tapering (angled) design, properly sized, has several features which are advantageous: satisfactorily uniform flow distribution can be achieved; overall pressure drop can be achieved which satisfies application requirements; sand and dust mitigation and compact assembly size (by having adjacent inlets and exits share the wall which forms the taper), as in FIG. 19. Alternatively, some weight can be saved by angling the panel faces to the incoming flow, as in FIG. 18, having adjacent inlet and exit pairs and eliminating the wall which separates alternating inlet and exit pairs.

FIG. 19 illustrates a configuration of foam metal core panels and flow ducting which achieves uniform air flow distribution across the face of each panel, as well as mitigates the effect of ingested sand and/or dust.

The heat exchanger inlets can be sized to mitigate the effects of ingested sand and dust. Sand and dust ingestion is mitigated by sizing the inlet such that large particles, which could clog the foam metal, fall out of the flow before these particles reach the core. Smaller particles pass through the core without causing clogging. The inlet sizing to achieve this result is evaluated by a combination of analysis and testing. Analysis is used to guide the initial sizing. Testing is used to refine and finally validate the sizing. Sizing for achieving uniform flow distribution is compared to sizing to mitigate sand and dust ingestion. The sizing requires that the larger inlet dimension is selected.

The heat exchanger design mitigates the potential negative effects of sand and dust using tapered inlets, sized using our method, such that particles which could clog the core fall out of the flow before reaching the core, and only particles which will pass through the core reach the core.

The invention provides a method of ensuring substantially uniform flow across the face of the heat exchanger panels when mounted in the various configurations. First the approach duct is sized such that the axial approach flow velocity head is small compared to the pressure drop through the foam metal core. One tenth or less is a starting goal. Testing and flow analysis and duct shape are used to achieve uniform flow distribution, as well as a small volume occupied by the duct.

Porous Metal Heat Exchanger (PMHX) Cores have demonstrated the capability to be significantly smaller and lighter than Advanced Fin Heat Exchanger cores (AFHX) while exchanging the same heat, at the same operating conditions. This capability has been demonstrated both in experimental testing and analytical sizing of PMHX cores. In addition, the PMHX LCS conceptual designs have demonstrated significant growth potential within the same pod. However, porous metal cores are not a direct swap out for advanced fin cores. In order to maintain acceptable pressure drop, PMHX cores need to be a panel shape rather than the box shape of AFHX. These PMHX panels can be packaged in a variety of ways.

PMHX core packaging concepts include W configurations, shelf configurations and structurally integrated panels. All of these configurations have the cooling air flow enter the PMHX core assembly transverse to the face of the core panels.

Angle flow inlets were conceived and sized with two objectives in mind: first, to achieve uniform air flow distribution through porous metal cores and second, to mitigate potential effects of ingested sand and dust.

A liquid-to-air foam metal heat exchanger can provide significant weight savings. Heat is rejected from liquid within the aircraft to air outside the aircraft. Air flows through a pod located outside the fuselage. To meet that requirement, heat exchangers using advanced conventional fin technology would have to be larger and heavier than desired. Foam metals have the potential to provide significantly better extended surface heat transfer for use in light, compact heat exchangers. Significant heat exchanger core size and weight savings have been projected for heat exchangers that utilize foam metal technology.

In one aspect, this invention provides a foam metal heat exchanger assembly including a flow inlet, guidance, and outlet ducting designed to provide substantially uniform flow through the heat exchanger. When mounted in a vehicle, vehicle movement through media such as air or water provides ram flow pressure to force fluid through the duct and heat exchanger. Alternatively, or in addition, a prime mover such as a fan or pump can be used to provide flow and pressure to force the fluid through the duct and heat exchanger. Generally, there are two sides to a heat exchanger. A moving vehicle, which rejects heat to the environment, can use ram air cooling, i.e., the motion of the vehicle forces air through the heat exchanger. However, the other side (i.e., the hot side) will generally have a fan, pump, etc. to circulate the fluid on that side.

Specific foam metal heat exchanger core and heat exchanger assembly inlet geometries which provide sufficiently uniform flow through the heat exchanger core at pressure drop and flow rates suitable for a given application, have been described. Larger cores can be formed by assembly of one or more sub-cores.

In one example, the face of the core (i.e., the large face area perpendicular to the flow through the foam metal) is parallel with respect to an intake/outlet flow direction of the fluid. Intake/outlet flow passages can be either of continuous height or tapered height along the Heat Exchanger Core (HEC) inlet (outlet) length. Tapered height along the HEC face is the preferred design. Proper sizing of the inlet/outlet is required to achieve acceptable pressure drop through the inlet-panel-outlet assembly and uniform flow distribution across the HEC face.

In another aspect the large face area of the foam metal panel may be at an acute angle with respect to an intake/outlet flow direction of the fluid.

Valuable space and weight can be saved by stacking two or more HEC panels such that the adjacent panel's outlet and inlet share the same duct wall.

In various embodiments, the heat exchangers include tapered inlets, sized to achieve low pressure drop and substantially uniform flow distribution. In addition, the space and weight savings for the HEC enable these heat exchangers to be attractive for aircraft, ship and submarine applications.

The heat exchanger core can include a large frontal coolant flow area and short coolant flow length. In one embodiment, a foam metal core can be positioned on one side and conventional extended or non-extended surface on the other side with either cross-flow or counter-flow arrangements. In another aspect, the invention encompasses a heat exchanger core including a foam metal attached to a heated surface to be cooled.

Open-celled foam metals promise much better heat transfer, compared with advanced fin heat exchangers. Potential benefits include reductions in the heat exchanger core volume and weight, as well as electronic device junction temperatures. Equally important is the possibility of direct-attached cooling of high-power electronics.

In one aspect, the invention provides a system comprised of a (a) foam metal heat exchanger assembly (b) flow inlet, guidance and outlet ducting designed to provide uniform flow through the heat exchanger, (c) a vehicle moving through media such as air or water which provides ram flow pressure to force the fluid through the foam metal heat exchanger.

In another aspect, the invention provides a system comprised of a (a) foam metal heat exchanger (b) flow inlet, guidance and outlet ducting designed to provide uniform flow through the heat exchanger, (c) fluid prime movers such as fans or pumps to provide flow and pressure to force the fluid through the foam metal heat exchanger.

Specific foam metal heat exchanger core and heat exchanger assembly inlet geometries have been described, which provide sufficiently uniform flow through the heat exchanger core at pressure drop and flow rates suitable for a given application.

In one embodiment, the heat exchanger core includes large frontal coolant flow area and short coolant flow length.

In another embodiment, the heat exchanger core can comprise foam metal on one side and a conventional extended or non-extended surface on the other side with either cross-flow or counter-flow arrangements.

In another embodiment, the heat exchanger core can comprise foam metal on both sides with either cross-flow or counter-flow arrangements.

Cores such as those shown in FIGS. 5, 6 and 7 can be formed by assembly of one or more sub-cores.

In another embodiment, the heat exchanger core may only include foam metal attached to a heated surface to be cooled.

While the invention has been described in terms of several embodiments, it will be apparent to those skilled in the art that various changes can be made to the described embodiments without departing from the scope of the invention as set forth in the following claims.

What is claimed is:

1. An apparatus comprising:

a foam metal panel heat exchanger core positioned in a duct;

an inlet flow passage for directing a first fluid to the heat exchanger core; and an exit flow passage for directing the first fluid from the heat exchanger core;

wherein the inlet flow passage is tapered relative to an inlet face of the heat exchanger core and the exit flow passage is tapered relative to an outlet face of the heat exchanger core, and wherein the heat exchanger core includes a first plurality of foam metal panels for passing the first fluid, and a second plurality of foam metal panels for passing a second fluid, with panels of the second plurality of foam metal panels being positioned between panels of the first plurality of foam metal panels.

2. The apparatus of claim 1, wherein the foam metal has a higher flow resistance in the plane of the core than in a direction perpendicular to the first fluid flow direction.

3. The apparatus of claim 1, further comprising:

a plurality of separators in the duct forming a plurality of passages, wherein the foam metal panels in the heat exchanger core are positioned in the plurality of passages.

4. The apparatus of claim 1, wherein the foam metal panels in the heat exchanger core are arranged in a W configuration.

5. The apparatus of claim 1 wherein the first and second fluids flow in directions that are substantially anti-parallel to each other.

6. The apparatus of claim 1, wherein the first and second fluids flow in directions that are substantially perpendicular to each other.

7. The apparatus of claim 1, wherein the inlet flow passage is sized to mitigate the effects of ingested sand and dust.

8. The apparatus of claim 1, wherein the first fluid has a substantially uniform flow distribution through the heat exchanger core.

9. The apparatus of claim 1, wherein inlet and exit flow passages associated with adjacent panels are adjacent to each other.

10. The apparatus of claim 1, wherein the panels in the heat exchanger core comprise a compressed foam.

11. An apparatus comprising:

a foam metal heat exchanger;

a duct structured and arranged to provide uniform flow through the heat exchanger; and means for causing a fluid to flow through the foam metal heat exchanger, wherein the foam metal heat exchanger comprises foam metal on one side and an extended or non-extended surface on another side with either cross-flow or counter-flow arrangements.

12. The apparatus of claim 11, wherein the means for causing a fluid to flow through the foam metal heat exchanger comprises a vehicle coupled to the duct such that movement of the vehicle provides ram flow pressure to force a fluid through the foam metal.

13. The apparatus of claim 11, wherein the means for causing a fluid to flow through the foam metal heat exchanger comprises a fluid prime mover for providing flow and pressure to force a fluid through the foam metal.

14. The apparatus of claim 11, wherein the foam metal heat exchanger further comprises:

foam metal on a second side of the extended or non-extended core with either cross-flow or counter-flow arrangements.

15. An apparatus comprising:

a plurality of foam metal cores positioned adjacent to each other and separated by plates, wherein the foam metal cores are structured and arranged such that a first fluid flows in a first direction through a first set of the cores and a second fluid flows in a second direction through a second set of the cores.

16. The apparatus of claim 15, wherein the plates comprise fin stock.

17. The apparatus of claim 15, further comprising headers for directing the second fluid into the second set of the cores.

* * * * *